US008302221B1

(12) United States Patent
Camp, Jr.

(10) Patent No.: US 8,302,221 B1
(45) Date of Patent: Nov. 6, 2012

(54) MEDICAL ASSIST DEVICE WITH LIFT SEAT

(75) Inventor: William P. Camp, Jr., Vanlue, OH (US)

(73) Assignee: Pivot Assist, LLC, Findlay, OH (US)

( * ) Notice: Subject to any disclaimer, the term of this patent is extended or adjusted under 35 U.S.C. 154(b) by 0 days.

(21) Appl. No.: 13/038,238

(22) Filed: Mar. 1, 2011

Related U.S. Application Data

(63) Continuation of application No. 12/660,415, filed on Feb. 26, 2010.

(60) Provisional application No. 61/209,047, filed on Mar. 3, 2009.

(51) Int. Cl.
*A61G 7/00* (2006.01)

(52) U.S. Cl. ..... 5/81.1 RP; 5/81.1 R; 5/86.1

(58) Field of Classification Search ..... 5/81.1 RP, 5/81.1 R, 86.1, 507.1; 280/250.1, 304, 30
See application file for complete search history.

(56) References Cited

U.S. PATENT DOCUMENTS

| | | | |
|---|---|---|---|
| 271,054 | A | 1/1883 | Fowler |
| 1,321,874 | A | 11/1919 | Zimmerman |
| 1,334,901 | A | 3/1920 | Higdon |
| 2,192,821 | A | 3/1940 | Torines |
| 2,323,500 | A | 7/1943 | Trigg |
| 2,404,734 | A | 7/1946 | Lenehan |
| 2,468,419 | A | 4/1949 | Weber |
| 2,757,388 | A | 8/1956 | Chisholm |
| 2,779,642 | A | 1/1957 | Matthews |
| 2,975,435 | A | 3/1961 | Forrest |
| 3,052,894 | A | 9/1962 | Bigger |
| 3,100,639 | A | 8/1963 | Bonewitz |
| 3,455,531 | A | 7/1969 | Baker |
| 3,911,509 | A | 10/1975 | Fleckenstein |
| 3,936,026 | A | 2/1976 | Hampel et al. |
| 3,962,736 | A | 6/1976 | Fedele |
| 4,026,279 | A | 5/1977 | Simjian |
| 4,034,947 | A | 7/1977 | Geisel |
| 4,056,886 | A | 11/1977 | Doelling |
| 4,073,551 | A | 2/1978 | Sutowski |
| 4,092,748 | A | 6/1978 | Ewers |

(Continued)

FOREIGN PATENT DOCUMENTS

JP 10-179644 7/1998

(Continued)

OTHER PUBLICATIONS

Action Engineering, Inc.; Assist-A-Lift Chair (product information); Able Rehab. Equipment (supplier); downloaded Jun. 15, 2011.

(Continued)

*Primary Examiner* — Fredrick Conley
(74) *Attorney, Agent, or Firm* — Shay Glenn LLP

(57) ABSTRACT

A medical assist device for a patient has a rotatable platform with a seat adjacent the platform and a lift mechanism for moving the seat from a lowered position for supporting a patient to a raised position and likewise able to move said seat from a raised position for supporting a patient to a lowered position. The rotatable platform can be rotated only if the seat is in the lowered position and the lift mechanism for raising the seat can be actuated only if the rotatable platform is in a predetermined position at which an open space between support bars is facing the seat.

17 Claims, 20 Drawing Sheets

U.S. PATENT DOCUMENTS 4,117,627 A 10/1978 Slingerland, Jr.
4,130,280 A 12/1978 Lowell
4,157,633 A 6/1979 Reiner et al.
4,200,282 A 4/1980 Agyagos
4,216,727 A 8/1980 Cunningham
4,219,715 A 8/1980 Mandle et al.
4,225,988 A 10/1980 Cary et al.
4,254,319 A 3/1981 Beh et al.
4,279,043 A 7/1981 Saunders
4,319,749 A 3/1982 Agyagos
4,330,696 A 5/1982 Pomeroy et al.
D265,218 S 6/1982 Robinett
4,344,243 A 8/1982 Reszka
D267,513 S 1/1983 Weigel
4,434,343 A 2/1984 Bowen et al.
4,506,930 A 3/1985 Lambert
4,523,070 A 6/1985 Jorgensen et al.
4,563,070 A 1/1986 Saito et al.
4,590,351 A 5/1986 Pomroy et al.
4,625,087 A 11/1986 Jorgensen et al.
4,636,605 A 1/1987 Berend et al.
4,647,745 A 3/1987 Danley
4,694,132 A 9/1987 Liu
4,747,170 A 5/1988 Knouse
4,753,173 A 6/1988 James
4,791,705 A 12/1988 Corominas
4,808,781 A 2/1989 Liu
4,843,665 A 7/1989 Cockel et al.
4,852,193 A 8/1989 Alsip et al.
4,856,128 A 8/1989 Alsip et al.
4,866,796 A 9/1989 Robinson et al.
4,885,446 A 12/1989 Liu
D306,325 S 2/1990 Maness
4,910,818 A 3/1990 Grabill et al.
4,920,589 A 5/1990 LaVelle et al.
4,934,003 A 6/1990 Hayakawa et al.
4,934,843 A 6/1990 Nakanishi
4,944,053 A 7/1990 Smith
4,944,054 A 7/1990 Bossert
4,969,290 A 11/1990 Skoretz
4,969,685 A 11/1990 Chihaya et al.
5,000,513 A 3/1991 Schmidt
D316,889 S 5/1991 Smith
5,023,974 A 6/1991 Coles
5,054,137 A 10/1991 Christensen
5,059,755 A 10/1991 Nottingham et al.
5,068,931 A 12/1991 Smith
5,079,789 A 1/1992 Jandrakovic
5,096,008 A 3/1992 Mankowski
5,152,024 A 10/1992 Chrones et al.
5,168,587 A 12/1992 Shutes
5,210,887 A 5/1993 Kershaw
5,265,935 A 11/1993 Geisler et al.
5,274,862 A 1/1994 Palmer, Jr. et al.
5,282,284 A 2/1994 Brantman et al.
5,311,622 A 5/1994 Allen
D351,026 S 9/1994 Madera
5,366,036 A 11/1994 Perry
5,381,569 A 1/1995 Church
5,417,129 A 5/1995 Baron
5,427,426 A 6/1995 Grappo
5,441,329 A 8/1995 Janisch
5,456,655 A 10/1995 Morris
5,507,044 A 4/1996 Williamson et al.
5,524,303 A * 6/1996 Palmer et al. ..... 5/81.1 RP
5,539,941 A 7/1996 Fuller
5,544,371 A 8/1996 Fuller
5,560,057 A 10/1996 Madsen
5,564,788 A 10/1996 Warhaftig
5,606,754 A 3/1997 Hand et al.
5,623,948 A 4/1997 Van Morris
5,641,140 A 6/1997 Sorenson
5,659,905 A 8/1997 Palmer, Jr. et al.
5,673,443 A 10/1997 Marmor
5,673,802 A 10/1997 Valentino
D390,958 S 2/1998 Lathrop
5,730,690 A 3/1998 Guidry
5,735,002 A 4/1998 Kistner
5,737,781 A 4/1998 Votel
5,758,736 A 6/1998 Yamauchi
5,762,398 A 6/1998 Gonzalez et al.
5,765,913 A 6/1998 LaPointe et al.
5,772,234 A 6/1998 Luo
5,788,618 A 8/1998 Joutras
5,807,210 A 9/1998 Devlin
5,809,930 A 9/1998 Brooks
5,819,339 A 10/1998 Hodgetts
5,830,107 A 11/1998 Brigliadoro
5,879,275 A 3/1999 Aruin
5,879,281 A 3/1999 Ein-Gal
5,890,238 A 4/1999 Votel
5,892,989 A 4/1999 Kawasaki et al.
5,946,748 A 9/1999 Wang
5,950,751 A 9/1999 McComber
D415,224 S 10/1999 Broudy et al.
6,023,247 A 2/2000 Rodeffer
6,038,717 A 3/2000 Persson
6,049,923 A 4/2000 Ochiai
6,053,572 A 4/2000 Doran
6,062,584 A 5/2000 Sabol
6,098,216 A 8/2000 Williamson et al.
6,099,281 A 8/2000 Sobel
6,119,287 A 9/2000 Phillips
6,119,292 A 9/2000 Haas
D431,616 S 10/2000 Broudy et al.
6,154,900 A 12/2000 Shaw
6,180,923 B1 1/2001 Yang
6,231,020 B1 5/2001 Willson
6,244,426 B1 6/2001 Murano et al.
6,289,533 B1 9/2001 Hodgetts
6,328,267 B1 12/2001 Mori
6,341,393 B1 1/2002 Votel
6,360,386 B1 3/2002 Chuang
6,378,148 B1 4/2002 Votel
6,390,415 B1 5/2002 Almen
6,496,991 B1 12/2002 Votel
6,502,260 B2 1/2003 Viljoen et al.
6,507,963 B2 1/2003 Hodgetts
6,512,490 B1 1/2003 Lee
6,543,727 B2 4/2003 Click et al.
6,546,891 B1 4/2003 Scarborough
6,565,315 B1 5/2003 Bertels et al.
6,568,646 B2 5/2003 Wess et al.
6,578,854 B2 6/2003 Wucherpfennig et al.
6,581,500 B1 6/2003 Kietaibl
6,584,628 B1 7/2003 Kummer et al.
6,794,841 B1 9/2004 Vang et al.
7,090,297 B2 8/2006 Mohn et al.
7,165,276 B2 1/2007 Hahn et al.
7,191,477 B2 * 3/2007 Hahn et al. ..... 5/81.1 RP
7,377,285 B2 5/2008 Karasin et al.
7,461,896 B2 12/2008 Welles et al.
7,591,774 B1 9/2009 Tien
2002/0000702 A1 1/2002 Charron
2003/0189311 A1 10/2003 Chen et al.
2006/0254633 A1 11/2006 Willis
2007/0018426 A1 1/2007 Willis
2007/0063480 A1 3/2007 Porcheron
2007/0152416 A1 7/2007 Willis
2008/0302402 A1 12/2008 Ryan et al.
2009/0072513 A1 3/2009 Perk
2010/0163087 A1 7/2010 Catton
2010/0263697 A1 10/2010 Catton

FOREIGN PATENT DOCUMENTS

JP 2008-237470 10/2008
WO WO 2006/099391 A2 9/2006

OTHER PUBLICATIONS

ALC, Inc.; Action Lift Chair Regal Series 750 Infinite Sleeper Lift Chair (product information); downloaded Jun. 15, 2011.
Altimate Medical; Easystand Bantam; 510K Summary (K091242); 5 pgs.; Apr. 23, 2009.
Altimate Medical; EasyStand Evolv; 510K Summary (K062402); 6 pgs.; Aug. 15, 2006.
Barton Medical Corp.; Convertible I-Series Positioning and Transfer Chair; 510K Summary (K071793); 6 pgs.; Jun. 19, 2007.
Berkline Corp.; Model LC Series Lift Out Chairs; 510K Summary (K023521); 5 pgs.; Sep. 24, 2002.
Bushline Corp.; Care Chair 1, 2, & 3; product detail (from AbleData); downloaded Jun. 15, 2011.
Design Specific LTD.; Wheelchair Platform; 510K Summary (K073565); 7 pgs.; Oct. 21, 2008.
Economic Mobility, Inc.; Aerolet ToiletLift; 510K Summary (K031045); 4 pgs.; May 25, 2003.
Franklin Corp.; Franklin Lift Chair (product information); 1 pg.; downloaded Jun. 15, 2011.
Freedom Designs; Gizmo Mechanical Wheelchair; 510K Summary (K023574); 3 pgs.; Nov. 6, 2002.
Fresenius Medical Care; Medical Treatment Chair; 510K Summary (K091727); 10 pgs.; May 8, 2009.
Golden Tech. Inc.; Capri Power Lift Chair (product brochure); 2 pgs.; downloaded Jun. 16, 2011.
Invacare Corp.; Model LC Series Lift Out Chairs; 510K Summary (K002171); 5 pgs.; Jul. 12, 2000.
Kemmerer, Ken; Electric Seat Lift Chair; 510K Summary (K961663); 1 pg.; May 29, 1996.
Medline Industries, Inc.; Medline Electronic Positioning Chair; 510K Summary (K001937); Jun. 21, 2000.
Merits Health Products Co., Ltd.; Model E Series Lift Chair; 510K Summary (K060212); 4 pgs.; Jan. 26, 2006.
Pride Health Care; Pride Lift Chair (product information and detail); distributor: Medic Rescue Health Care Co.; downloaded Jun. 16, 2011.
Pride Mobility Products Corp.; C5/Electric Positioning Chair; 510K Summary (K070950); 5 pgs.; Mar. 23, 2007.
Pride Mobility Products Corp.; T3/Electric Positioning Chair; 510K Summary (K091578); 5 pgs.; Oct. 21, 2009.
Rehab Seating Systems, Inc., formerly Med-West, Inc.; (product detail from AbleData); downloaded Jun. 16, 2011.
Wheelchairs of Kansas; Overlander PEV (product information); p. 9; downloaded Jun. 16, 2011.
Winco, Inc.; Winco Model Power Series Lift Chair; 510K Summary (K080533); 5 pgs.; Apr. 11, 2008.
Camp Jr., William P.; U.S. Appl. No. 12/660,415 entitled "Medical Assist Device With Lift Seat," filed Feb. 26, 2010.
Arva et al.; RESNA Position on the application of seat-elevating devices for wheelchair users; pp. 1-8; Sep. 2005.
Jones et al.; The national nursing home survey: 2004 overview; National Center for Health Statistics; Vital Health Stat; vol. 13; No. 167; Jun. 2009.
McMaster-Carr; Supply Brochure (Turntables); http://www.mcmaster.com/#turntables/=9msc51; pp. 1110-1111 & 2556; (printed: Nov. 8, 2010).
Rodosky et al.; The influence of chair height on lower limb mechanics during rising; J. Orthop. Res.; vol. 7; No. 2; pp. 266-271; 1989.

* cited by examiner

MEDICAL ASSIST DEVICE WITH LIFT SEAT

CROSS REFERENCE TO RELATED APPLICATIONS

This application is a continuation of U.S. patent application Ser. No. 12/660,415, filed on Feb. 26, 2010, titled "Medical Assist Device With Lift Seat", which claims the benefit under 35 U.S.C. 119 of U.S. Provisional Patent Application No. 61/209,047, filed on Mar. 3, 2009, titled "Medical Assist Device With Lift Seat". Each of these patent applications is herein incorporated by reference in its entirety.

INCORPORATION BY REFERENCE

All publications and patent applications mentioned in this specification are herein incorporated by reference to the same extent as if each individual publication or patent application was specifically and individually indicated to be incorporated by reference.

BACKGROUND OF THE INVENTION

The present invention is generally directed to the medical assist device for assisting in the transfer of an infirmed patient from a bed to a chair or chair to a wheelchair or back to bed from a wheelchair to a toilet or bathtub.

Reference is made to United States Letters Patent U.S. Pat. No. 7,191,477 B2, incorporated herein by reference, of which I am a co-inventor. The embodiment of FIGS. 25-29 of the above-identified patent discloses a medical assist device having a rotatable platform with a seat adjacent to the platform and with wheels. The present invention is an improvement in which there is provided a medical assist device having a lift seat to assist the patient from moving from the seat to the rotatable platform preparatory to rotation to the desired position for exiting the medical assist device.

It is an object of the present invention to provide apparatus with (1) a rotatable platform for rotatably shifting a patient positioned thereon, (2) a seat adjacent said rotatable platform, (3) wheels for moving a patient on the medical assistance device from one location to another and (4) a lift mechanism for lifting the seat to the point where the patient may easily leave the seat and stand on the platform. For reasons of patient safety and to prevent damage to the device, there are provided switches which permit rotation of the platform only when the seat is in the fully lowered position and which permit the seat to be raised only when the platform is in the proper rotational position, namely, a position directly facing the platform such that, when the seat is lifted, the patient will be able to move into a space between two gripping bars.

Additionally, the upward lift stroke is limited by design to prevent damage to the unit and to prevent lifting the patient into contact with the handlebars.

Other objects and advantages of the present invention will become readily apparent to those skilled in the art from a review of the detailed description of the preferred embodiment and the accompanying drawings.

DETAILED DESCRIPTION OF THE INVENTION

Figure 1:
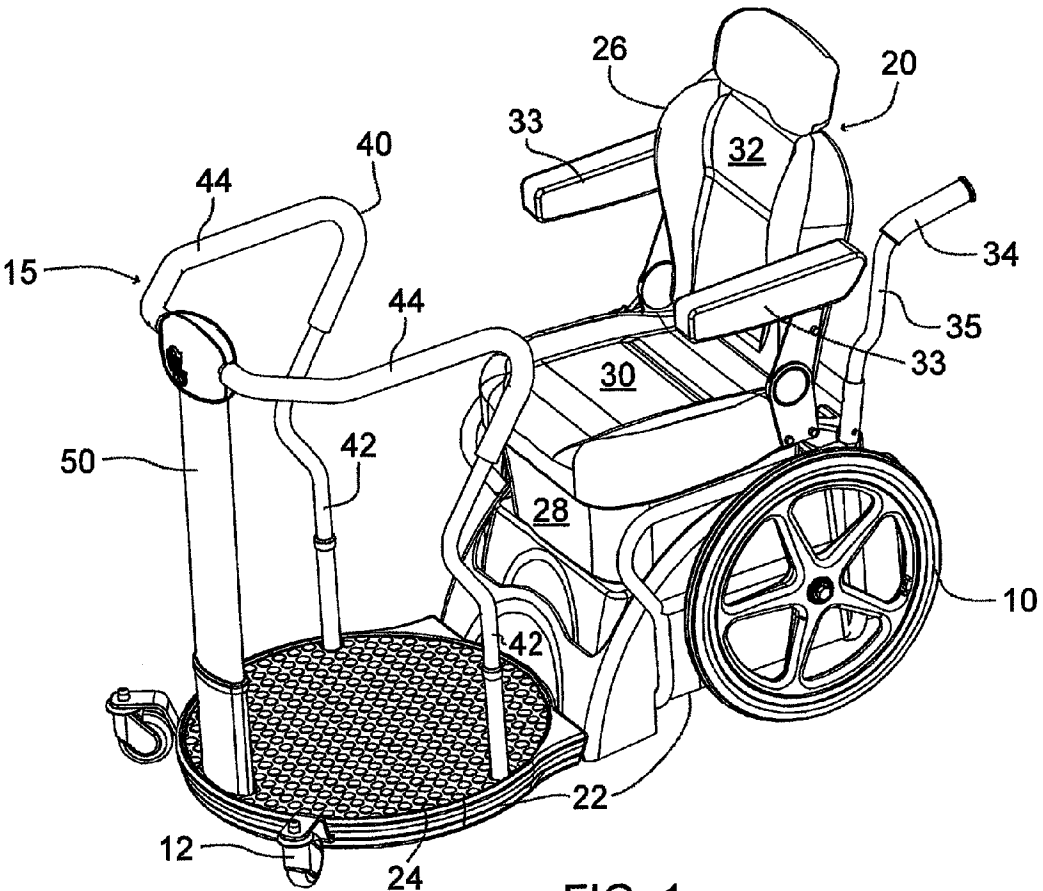
FIG. 1 is a perspective view of the medical assistance device taken from a front corner with the seat in the lowered position and the platform rotated to receive a patient who would be sitting in the device (home position).

Referring to the drawings there is shown a medical assist device 20 having a frame 22 on which is mounted a rotatable platform 24 which is similar to that described in U.S. Pat. No. 7,191,477 B1, incorporated herein by reference. A patient gripping assembly 15 is mounted on and extends upwardly from the rotatable platform 24.

Also mounted on the frame 22 adjacent the rotatable platform 24 is a seat assembly 26 having a raised platform 28 on which is mounted a seat 30 on which a patient may be seated. The seat assembly 26 also includes a back 32, arm rests 33 and a pair of spaced apart handles 34 on the opposite side of said seat from said rotatable platform for gripping by an attendant when pushing the medical assist device 20. The frame 22 is supported on a pair of rear wheels 10 and a pair of front casters 12 and extends along an axial plane P defined by points midway between the rear wheels 10 and casters 12 and the center of the seat 30. See FIGS. 1E and 6.

Mounted on and extending upwardly from the rotatable platform 24 is a support assembly 50 and a pair of side gripping bars 44. The side gripping bars 44 are for gripping by a patient standing on the rotatable platform 24 and are supported by upwardly extending post portions 42 mounted on the rotatable platform. The gripping bar portions 44 are generally parallel to one another and parallel to the rotatable platform 24 with a space therebetween in which the patient may stand. Foam gripping members are positioned on the gripping bar portions 44. The gripping bar portions 44 are also secured to the support assembly 50.

Figure 6:
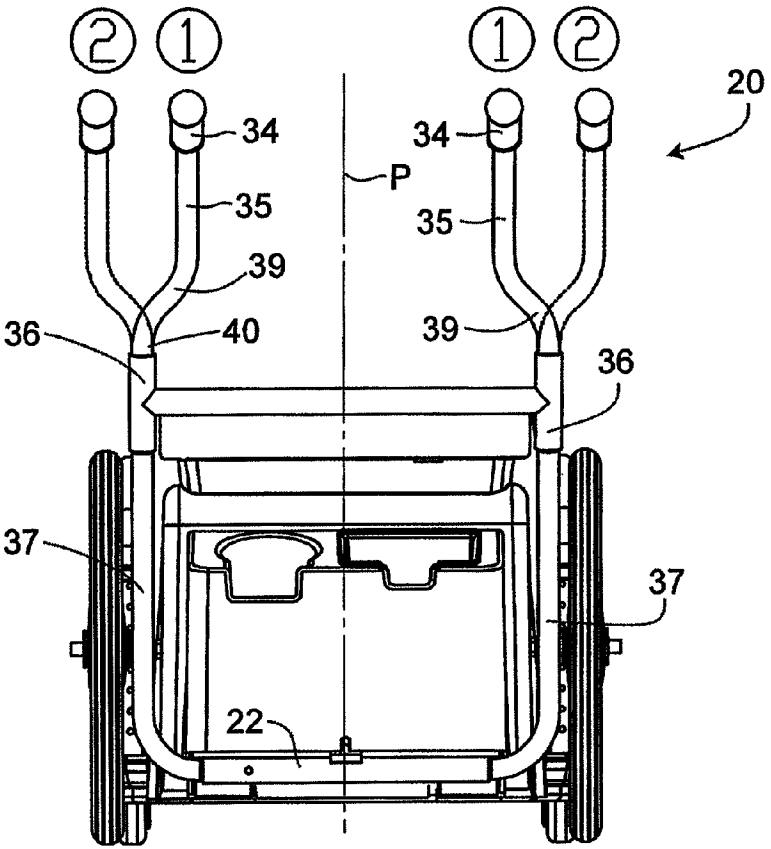
FIG. 6 is an elevational view taken from the rear of the medical assist device, showing in full lines the rear handles installed at an inward angle and in phantom lines, the rear handles installed outwardly.

The patient may be seated on the seat 30 and raised therefrom when the rotatable platform 24 is positioned with the support assembly 50 on the opposite side of the rotatable platform 24 from the seat assembly 26 and the opening between the gripping bars 44 facing the seat (home position). When the rotatable platform 24 is so positioned, the support assembly 50 will be aligned with axial plane P as shown in FIGS. 1E and 6. The patient can then be assisted to a standing position on the platform 24 by raising the seat assembly 26 as shown in FIG. 3. Following the lowering of the seat assembly 26 and with the patient standing on the platform, the attendant may actuate the motor (as hereinafter described) to rotate the rotatable platform 24 either clockwise or counter-clockwise to any desired position out of alignment with axial plane P, for example as shown in FIG. 2, to permit the patient to step off of the platform 24.

Figure 2:
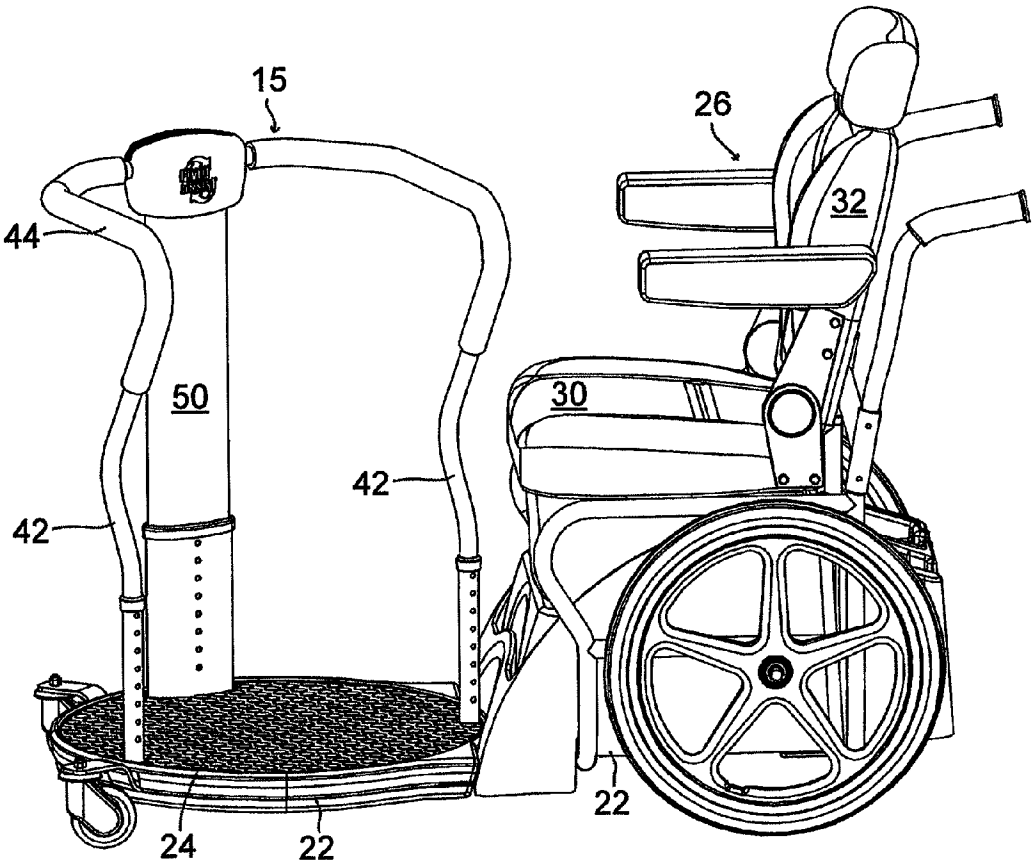
FIG. 2 is a perspective view taken from the side showing the seat in the lowered position and the platform rotated so that the gripping bars are out of alignment with the seat.
Figure 3:
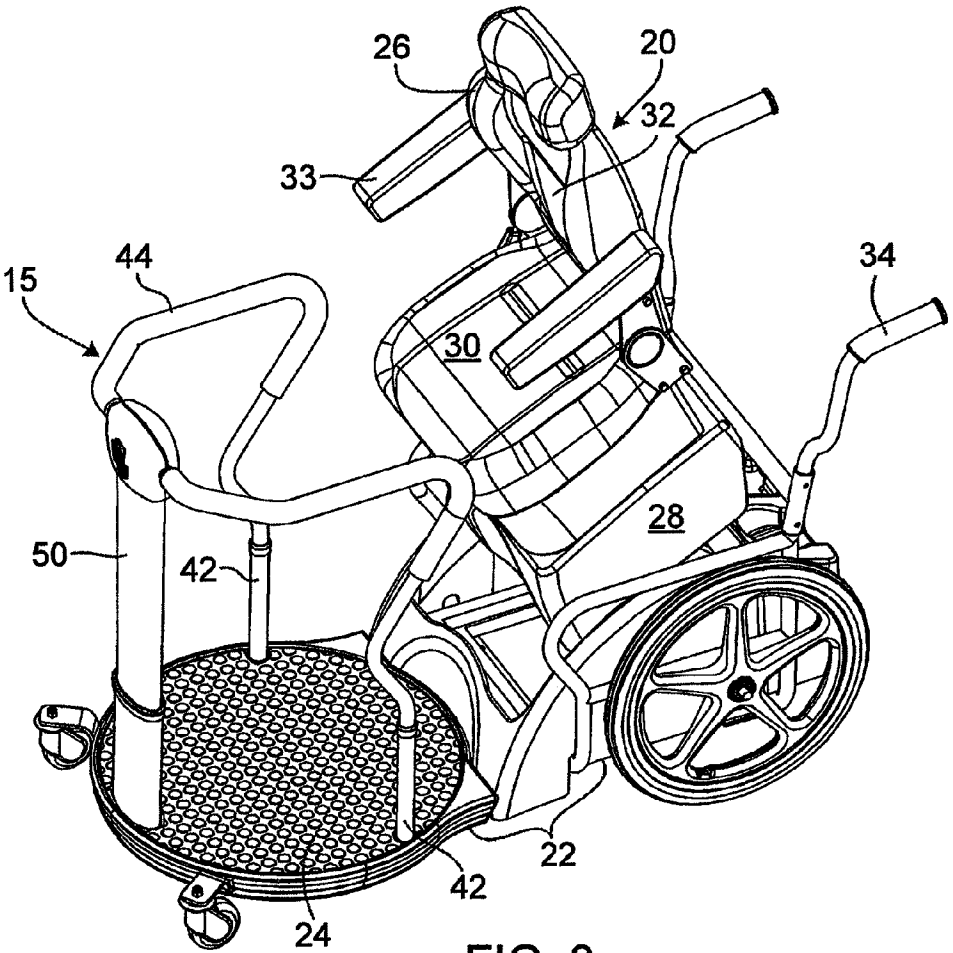
FIG. 3 is a perspective view with the platform rotated to receive a patient from the seat and the seat raised to assist the patient to a standing position on the platform.
Figure 3A:
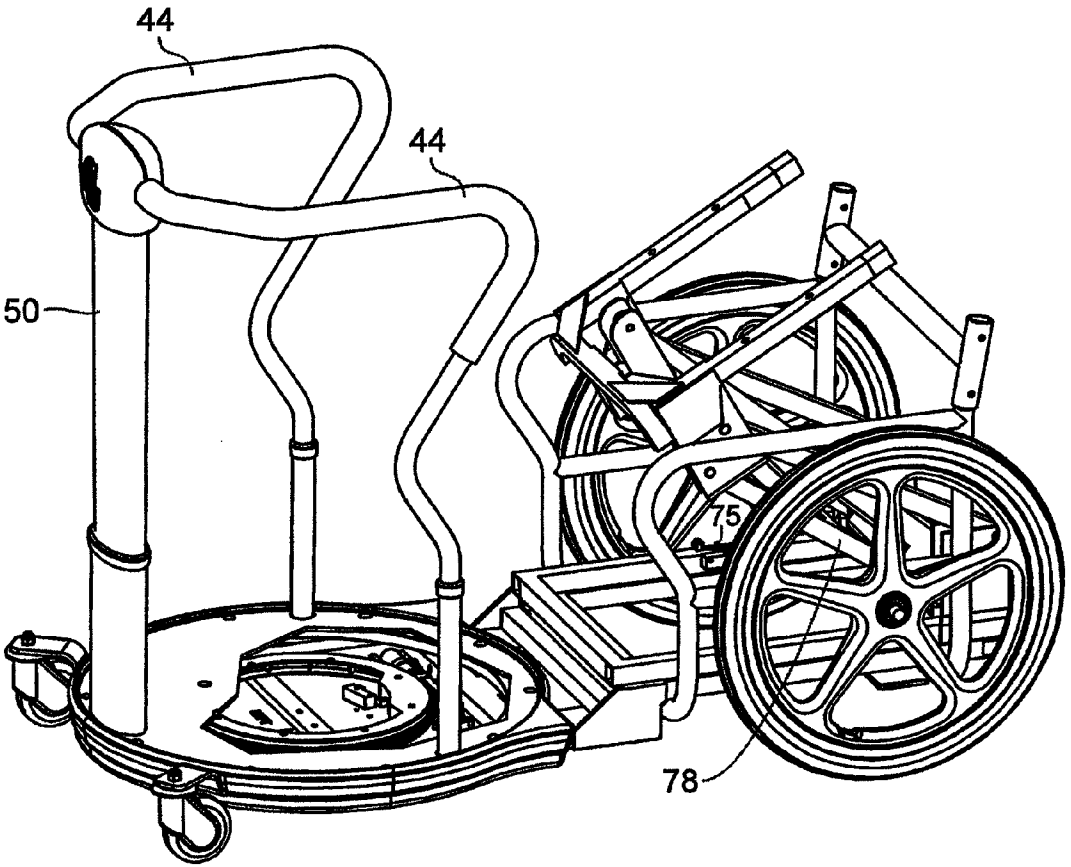
FIG. 3A is a breakaway view similar to FIG. 3 showing the relative position of the switches and their respective cam rollers when the platform is in the home position and the seat is elevated.
Figure 3B:
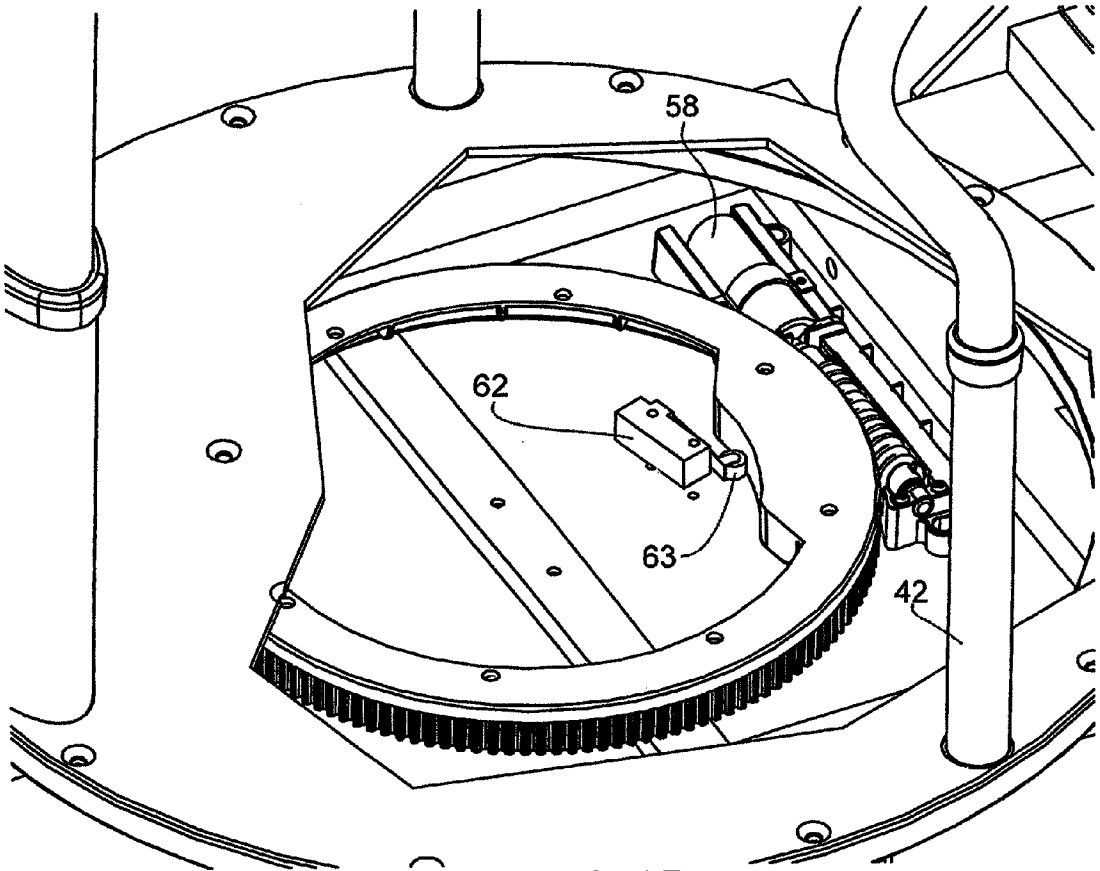
FIG. 3B is a view similar to FIG. 3A on an enlarged scale.
Figure 3C:
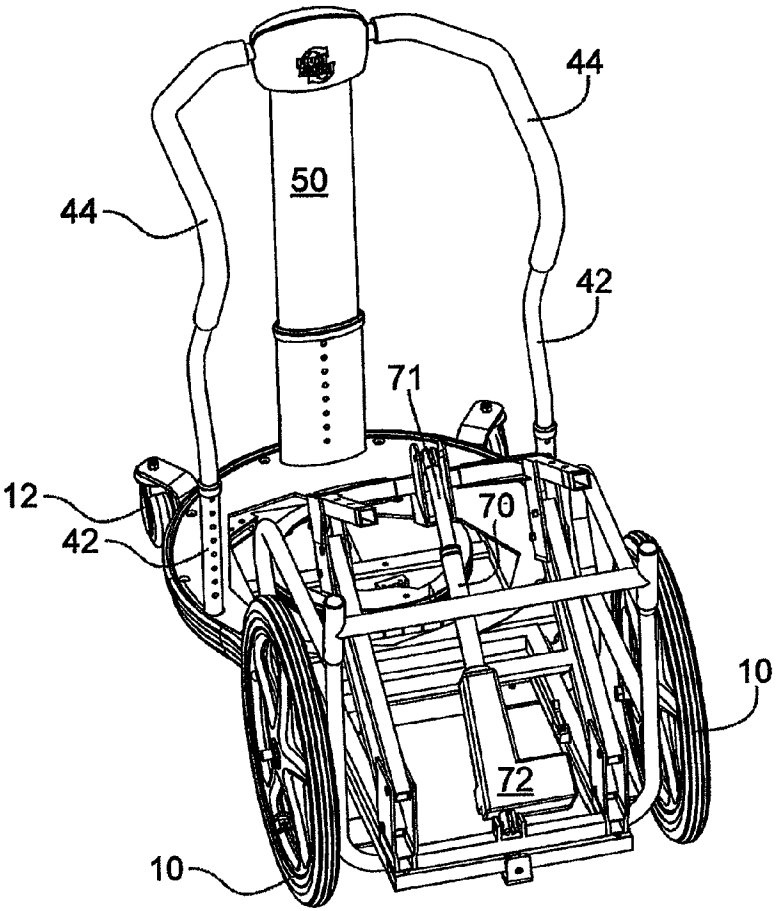
FIG. 3C is a view taken from the left rear of the device when the seat is in a raised position.

The lift mechanism features a contact switch and control mechanism interlocked with the rotating platform 24 so that the platform 24 cannot rotate unless the seat assembly 26 is fully in the lowered position as shown in FIGS. 1 and 2. This prevents the unit from being damaged as the seat 30, if in a raised or elevated position, would be hit by one or the other of the posts 42 or gripping bars 44 upon rotation of the platform 24.

The rotatable platform 24 also is electronically interlocked so that the lift mechanism cannot raise the seat assembly 26 unless the platform 24 is in the home position with the front gripping assembly 50 lying on axial plane P on the opposite side of the platform 24 from the seat assembly 26 with the seat 30 centered between the two gripping bar portions 44. As will be appreciated, if the seat assembly 26 were raised when the rotatable platform 24 was not in the "home position", the seat assembly 26 would strike a post 42, gripping bar 44 and/or support assembly and thereby damage the device. The sizing of the space between the post portions 42 is such relative to the seat assembly 26 that the seat cushion 30 will avoid contact with the post portions 42 and gripping bars 44 when the seat assembly 26 is moved to a raised position assuming, of course, that the platform 24 is in the rotational "home position". The arm rests 33 are in line with the gripping bars 44 but are prevented from contact when the seat is raised by the limits designed into the lift cylinder. Further, there is a gap of approximately 6 inches between the arm rests 33 in the fully raised position as shown in FIG. 3, which allows ample space for a patients forearm, wrist, and hand not to get trapped or injured between the arm rests 33 and the gripping bars 44.

Figure 1A:
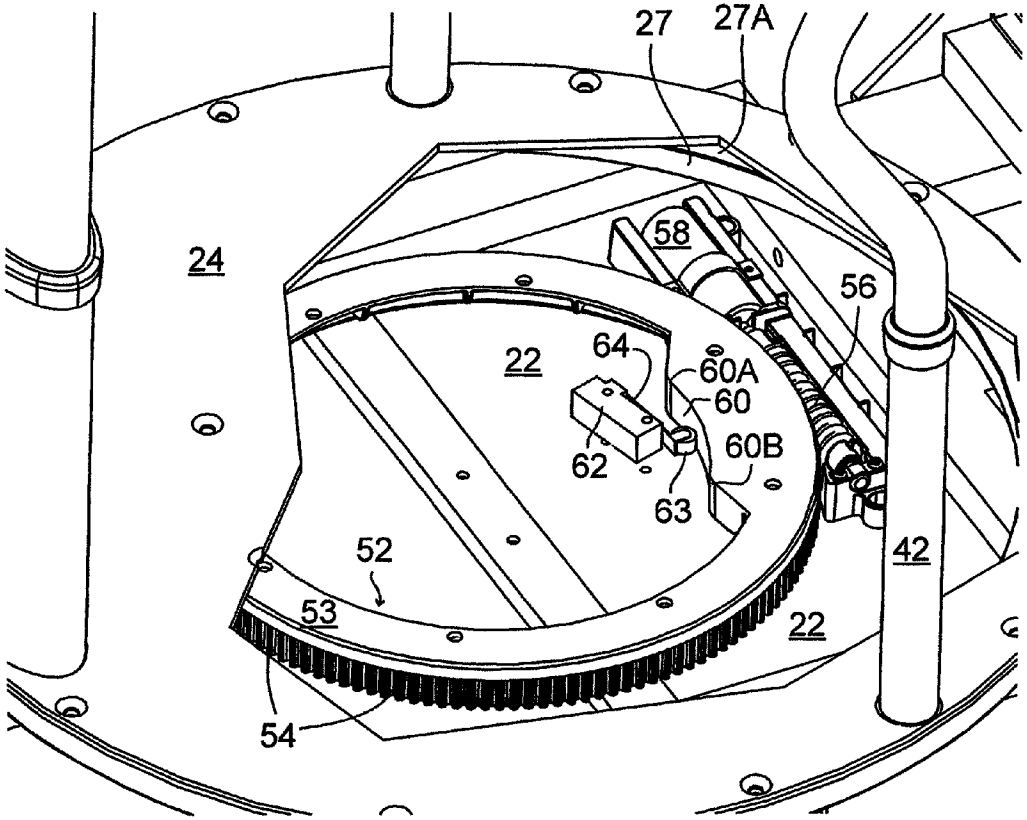
FIG. 1A is a fragmentary view showing the position of a switch and its cam roller relative to a cam surface when the seat is in the position shown in FIG. 1.
Figure 1B:
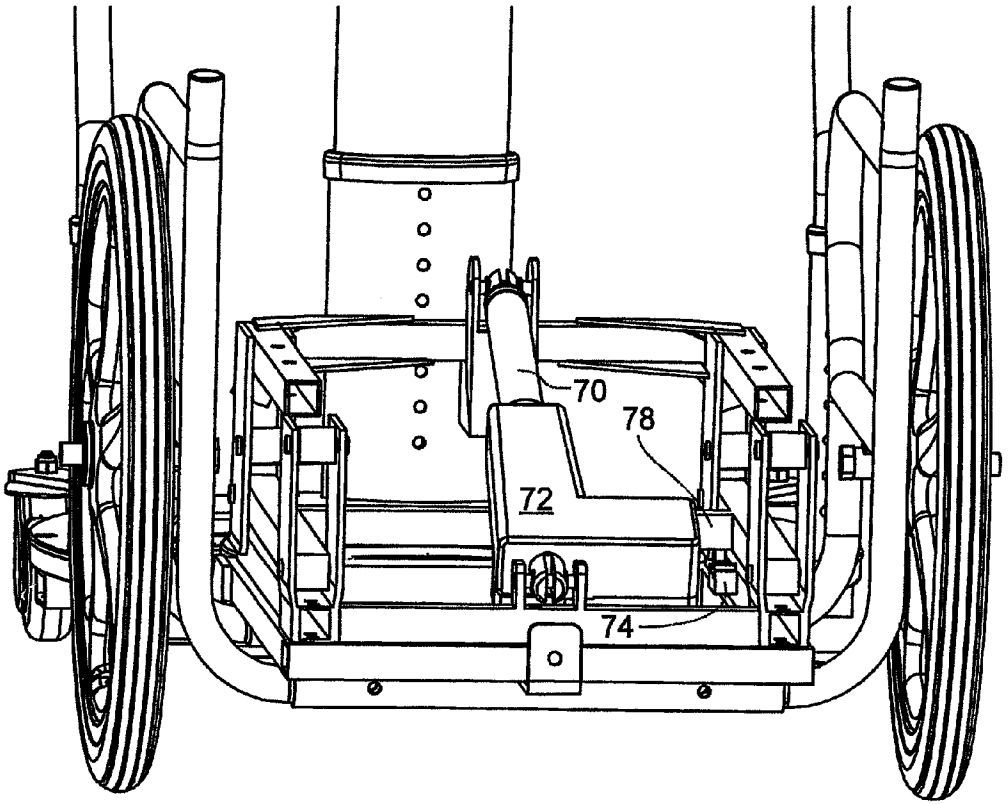
FIGS. 1B, 1C and 1D show the position of a second switch which has an arm and cam roller movable following actuation of the electric actuator to move the seat to a raised position, but shown with the seat in the lowered position.
Figure 1C:
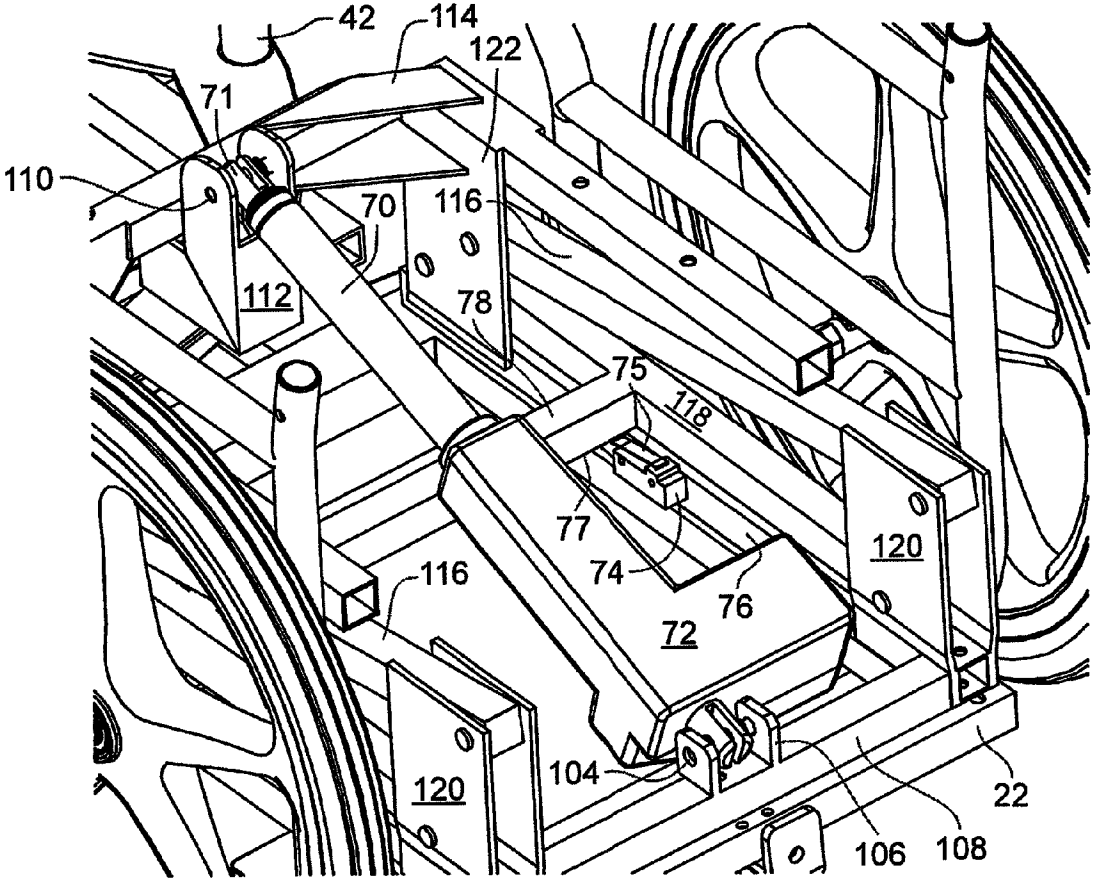
Figure 1D:
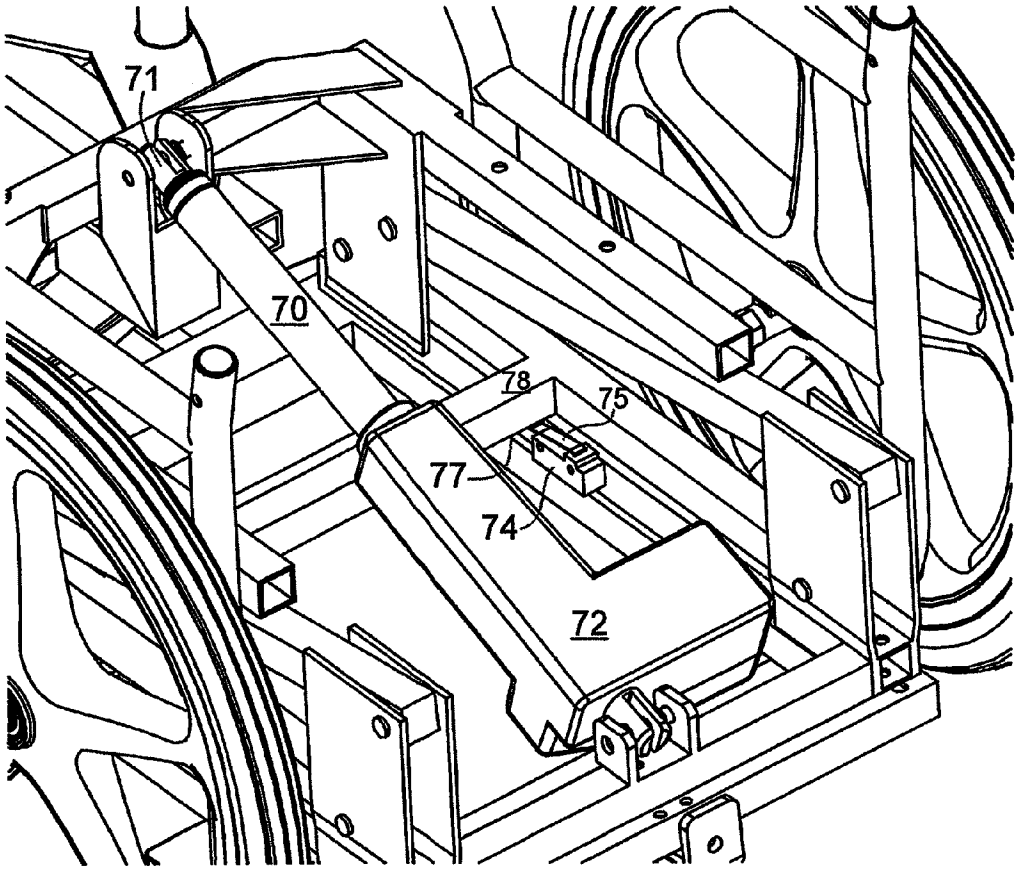
Figure 1E:
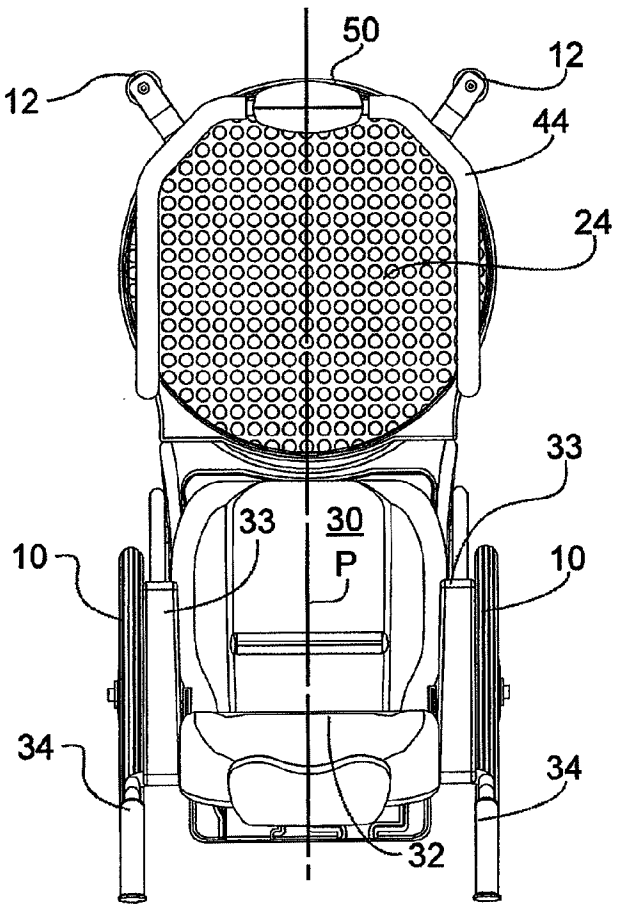
FIG. 1E is a schematic plan view showing the longitudinal axial plane of the device.

Referring to FIGS. 1A, 1B and 1C, there is shown mechanism for rotating the rotatable platform 24 and for raising and lowering the seat assembly 26. The rotatable platform 24 is supported on and affixed to a bearing assembly 27 the bearing assembly 27 (FIG. 1A) having an upper surface 27A on which the rotatable platform 24 is supported. Attached to the bottom of the rotatable platform 24 is the wheel assembly 52. Extending around the circumference of the wheel assembly 52 are a plurality of outwardly facing teeth 54. Rotation of the wheel assembly 52 relative to the frame 22 is effected by means of a worm gear 56 which engages the gear teeth 54 of the wheel assembly 52. The worm gear 56 is powered for rotation by an electric motor 58. Both the worm gear 56 and the electric motor 58 are supported on the frame 22.

Spaced inwardly from the gear teeth 54, the wheel assembly 52 is provided with an inwardly facing cam surface 60 defining a short arc extending approximately 40 degrees from a first end 60A to a second end 60B. Mounted on the frame 22 is a first contact switch 62 having a first cam roller 63 mounted on a spring loaded arm 64 extending from the first contact switch 62. The first contact switch 62 is interconnected with the mechanism controlling the raising and lowering of the seat such that the seat raising mechanism can be actuated to raise the seat assembly 26 only if the cam roller 63 is in contact with the cam surface 60 with such cam surface 60 holding the spring loaded arm 64 in its retracted position shown in FIG. 1A. Thus, if the wheel assembly 52 rotates the rotatable platform 24 to a position such that the support assembly 50 is not lying on axial plane P and the opening between the posts 42 and gripping bars 44 is not aligned with the seat 30 and back 32 of the seat assembly 26, the camming surface 60 will have moved out of contact with the cam roller 63 of the first contact switch 62 thereby permitting the spring loaded arm 64 to move outwardly to the position shown in FIG. 2A. In this connection it should be noted that the first contact switch 62 with its cam roller 63 and arm 62 is fixedly mounted on the frame 22 and does not rotate when the wheel assembly 52 is rotated by the worm gear 56. The movement of the spring loaded arm 64 to its outward position shown in FIG. 2A prevents the seat assembly 26 from being moved from its lowered position shown in FIGS. 1 and 2 to a raised position as shown in FIG. 3.

As shown in FIGS. 1B and 1C, movement of the seat assembly 26 from the lowered position shown in FIG. 1 to a raised position shown in FIG. 3 is effected by means of an electric actuator 70 driven by motor 72. As may be seen in FIGS. 1B and 1C there is provided a second switch 74 having a spring loaded arm 75 which, when the actuator rod 71 is retracted as shown in FIG. 1C so that the seat assembly is in the lowered position shown in FIG. 1, the arm 75 is maintained in a depressed position as a result of a cam roller on the end of the arm 75 being in engagement with the lower surface 77 of a cross member 78 of the frame. When the arm 75 of the second switch 74 is in the depressed position shown in FIG. 1C, the controls for actuation of the electric motor 58 powering the worm gear 56 may be activated permitting rotation of the wheel assembly 52 and the rotatable platform 24 mounted thereon.

The motor 72 is supported at its rear end on a hinge 104 pivotally engaged to a bracket 106 of cross member 108. The actuator 70 has an actuator rod 71 connected by a hinge 110 to a bracket 112 secured to a sub-assembly 114 supporting the seat assembly 26 including the platform and seat 30. The sub-assembly 114 is supported on a pair of spaced apart upper shafts 116 and a pair of spaced apart lower shafts 118. Each of the upper shafts 116 and the lower shaft 118 is pivotally connected at their rear ends to a bracket 120 of cross member 108 resting on the frame 22 and at their front ends to a bracket 122. Cross member 78 extends between and is supported on the lower shafts 118.

When the motor 72 is actuated to cause the actuator 70 to extend the actuator rod 71 to the position shown in FIGS. 3, 3A, 3B and 3C, the seat assembly 26 will be raised to the position shown in FIG. 3 to thereby assist a patient sitting thereon to rise and stand on the rotatable platform 24. Such extension of the actuator rod 71, in addition to elevating the seat assembly 26, causes the upper shafts 116 and lower shafts 118 to pivot in the respective rear brackets 120 and forward brackets 122 thereby elevating the sub-assembly 114 and the seat assembly 26. The movement of all portions of the lower shafts 118 forwardly of their hinge connection to bracket 120 to the raised position of FIGS. 3A, 3B and 3C, causes the cross member 78 to elevate thereby permitting the spring loaded arm 75, whose cam roller had rested against the lower surface 77 of the cross member 78, to move upwardly to the position shown in FIGS. 3A and 3B. The second contact switch 74 is bolted to rail 76 on which it is supported. Such movement upwardly of the spring loaded arm 75 prevents actuation of controls which would cause the electric motor 58 to rotate the worm gear 56 and the wheel assembly 52. Thus, when the seat assembly 26 is in the elevated position shown in FIG. 3, it is not possible to rotate the wheel assembly 52 and the rotatable platform 24 mounted thereon. Any such rotation would, of course, seriously damage the device.

The lift actuator 70 is manufactured by Linak USA, Inc. as its item No. PLA31-00200 24V with a specified length of stroke designed such that as previously discussed, when fully extended, there will be approximately a 6 inch gap between the fronts of the arm rests 33 and the closest portions of the gripping bars 44. Additionally, limiting the length of the stroke insures that the seat assembly 26 does not move the patient so far forward that he/she will lose his or her balance. On the way down, the stroke is similarly limited so that seat assembly 26 will not crash into the frame.

Figure 4:
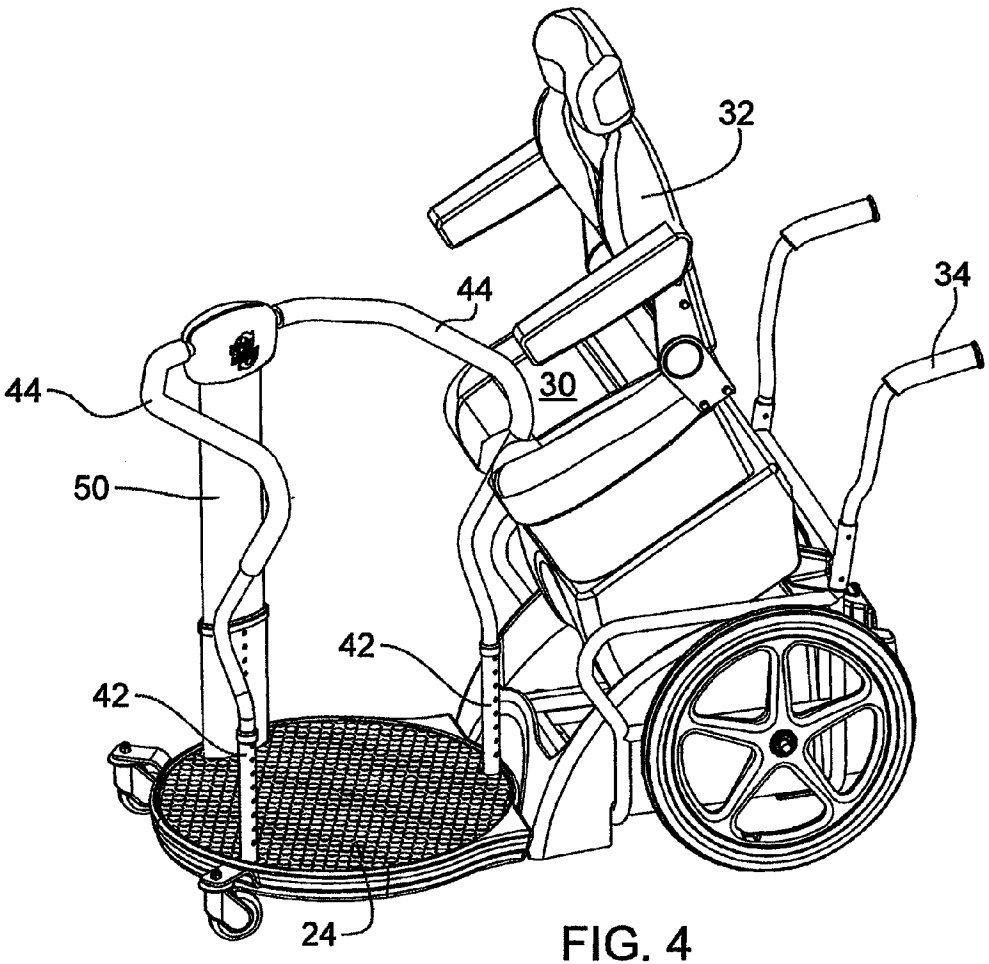
FIG. 4 is a perspective view showing the interference which would occur if the seat were moved to a raised position when the rotatable platform was not in its home position for receiving a patient from the seat.

FIG. 4 shows what would happen if the first and second contact switches 62 and 74 were not provided and an attendant attempted to raise the seat assembly 26 when the rotatable platform 24 was rotated to a position out of alignment to receive a patient from the seat assembly. As can be seen in FIG. 4 the seat assembly has pushed against the post 42 and one of the gripping bars 44 which would cause serious damage.

Figure 5A:
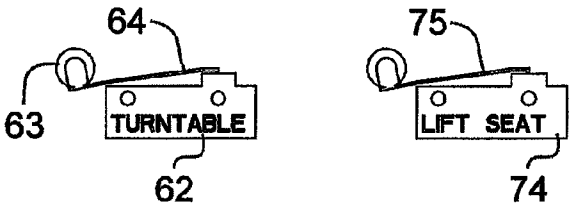
FIGS. 5A-5E are schematic views showing the positions of the cam rollers and spring loaded arms for the two switches when the rotatable platform (turntable) and the lift seat are in various positions shown in the earlier Figs.

FIGS. 5A-5E show schematically the respective positions (1) of the arm 64 of the first contact switch 62 which is actuatable upon rotation of the rotatable wheel assembly 52 and platform 24 and (2) of the arm 75 of the second switch 74 which is actuatable upon movement of the actuator rod 71 from the retracted position to an extended position raising the seat assembly 26 to an elevated position. FIG. 5A represents the position of the respective switches 62 and 74 when the seat assembly 26 is in the lowered position and the turntable 24 is rotated to the home position shown in FIG. 1 in which the support member 50 lies on the axial plane P and the gripping members 44 are open in the area opposite the seat 30. In this position, the cam roller of switch 62 is engaged to the cam face 60 thereby maintaining the arm 64 in a depressed position and the cam roller of switch 74 engaged to the lower surface 77 of cross member 78 thereby maintaining the arm 75 in a depressed position.

Figure 2A:
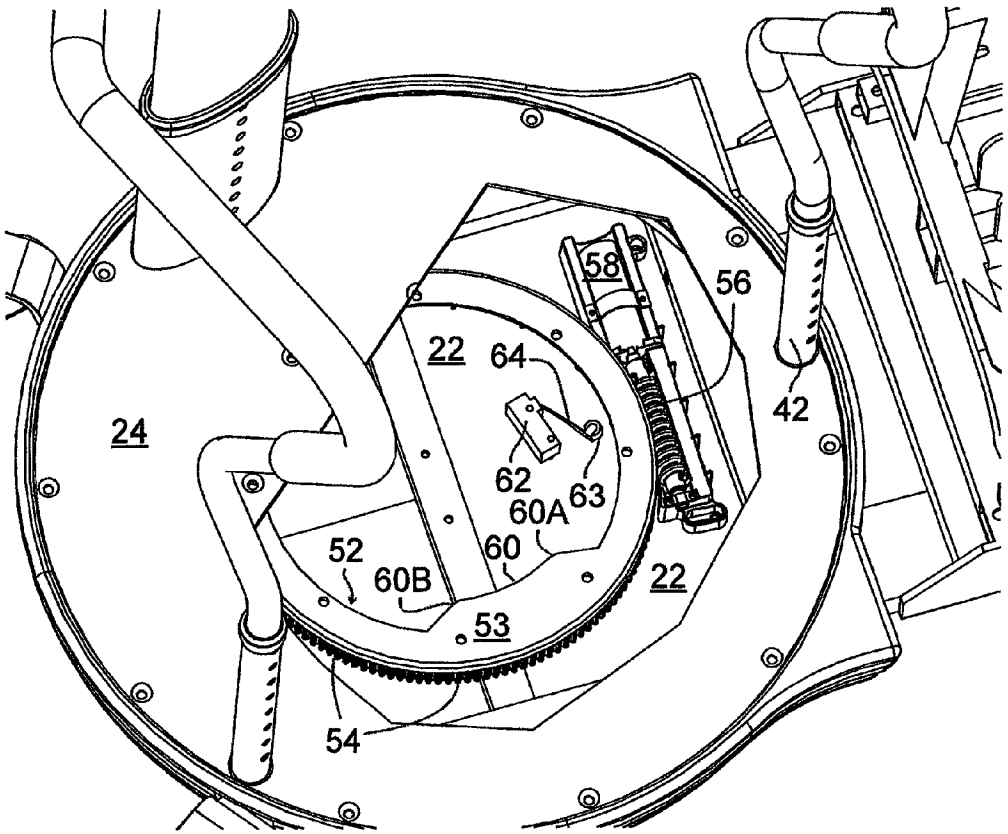
FIG. 2A is a view similar to FIG. 1A showing the position of the switch and cam roller relative to the cam surface when the platform has been rotated to the position shown in FIG. 2.
Figure 2B:
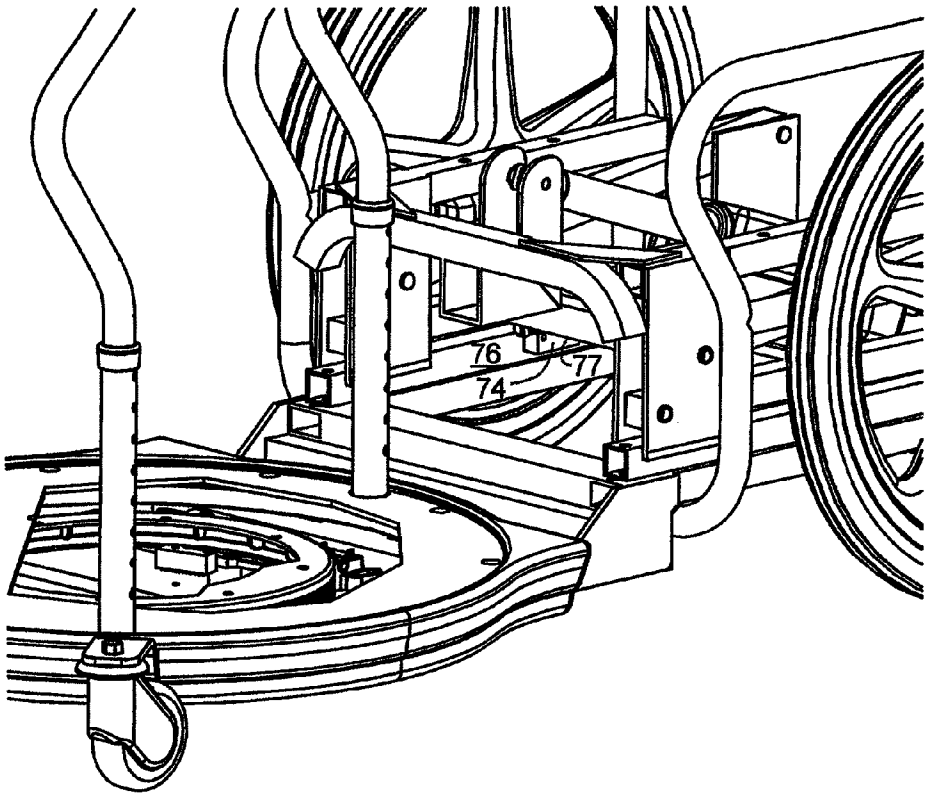
FIG. 2B is a fragmentary perspective view taken from the front side showing the position of the second switch and its spring loaded arm with the seat in the lowered position.
Figure 2C:
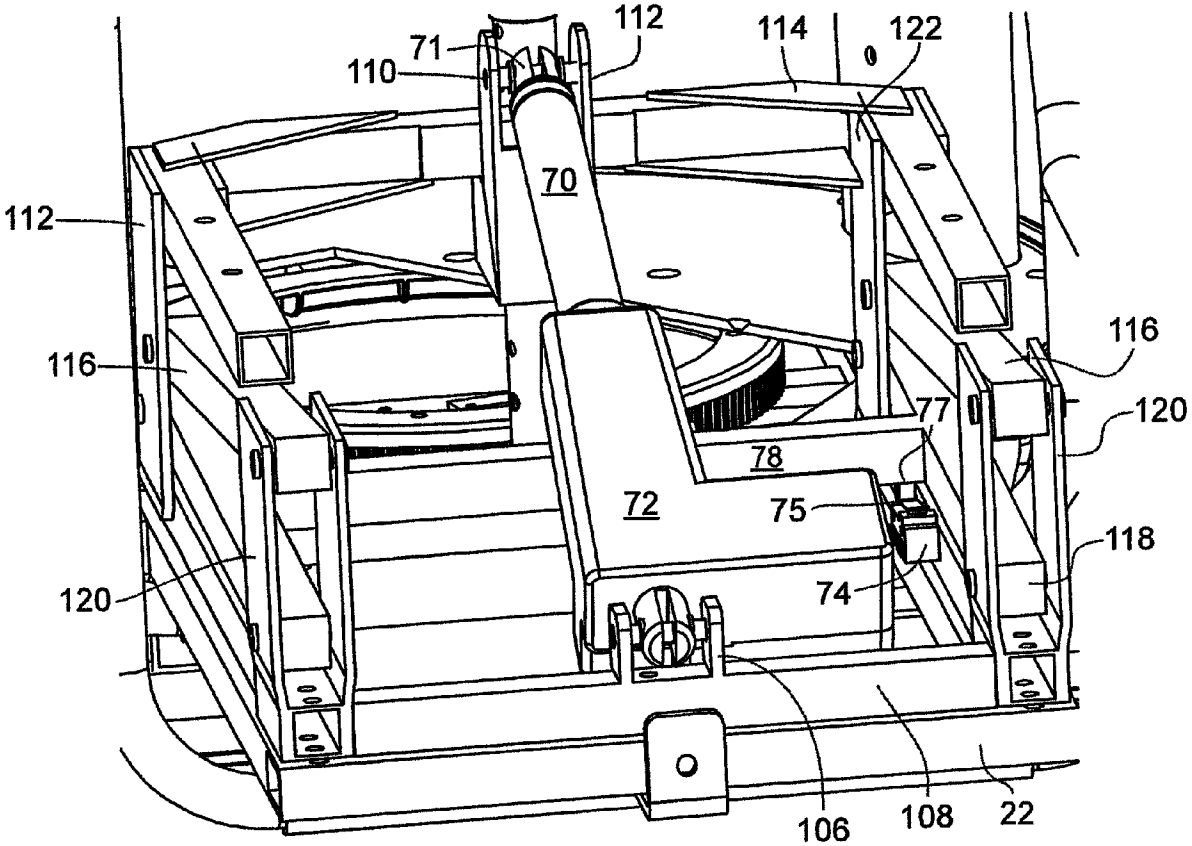
FIG. 2C is a view taken from the rear of the device when it is in the position of FIG. 2.
Figure 5B:
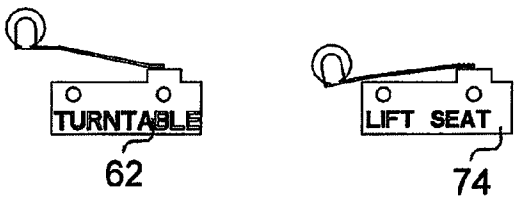

FIG. 5B represents the position of the cam roller 63 of switch 62 after the rotatable platform 24 has been rotated to the position shown in FIG. 2A. When in such position the seat assembly 26 must remain in the lowered position.

Figure 5C:
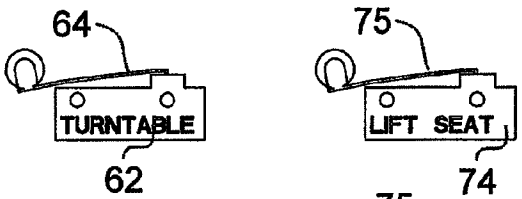
Figure 5D:
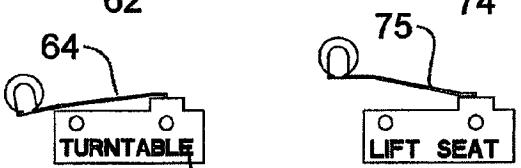

FIG. 5C represents the position of the respective arms 64 and 75 of switches 62 and 74 after the rotatable platform 24 returns to the home position. Now that the rotatable platform 24 is in the home position, the actuator 70 may be actuated to extend the actuator rod 71 thereby lifting the seat assembly 26 and causing the lower shaft 118 to elevate carrying with it the cross member 78 and disengaging the lower surface 77 of the cross member from the cam roller of the arm 75 permitting the arm to move upwardly as shown in FIG. 5D. Such movement of the arm 75 of the switch 74 prevents actuation of the motor 58 controlling rotation of the wheel assembly 52 and the rotatable platform 24 carried thereby.

Figure 5E:
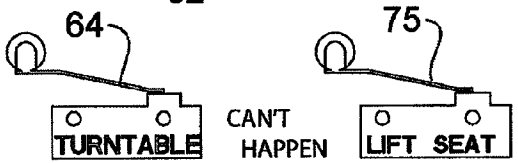

FIG. 5E shows both arms 64 and 75 of the respective switches, 62 and 74 in a raised position and illustrates the fact that both arms 64 and 75 cannot be elevated at the same time.

Figure 7C:
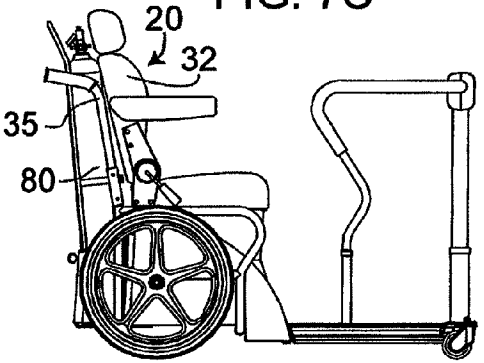
FIGS. 7A, 7B and 7C are views taken from various angles of the medical assist device with the seat in an upright position and the rear handles angled inwardly.
Figure 7B:
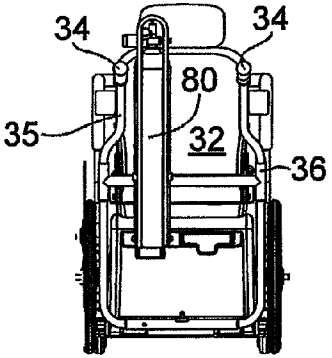
Figure 7A:
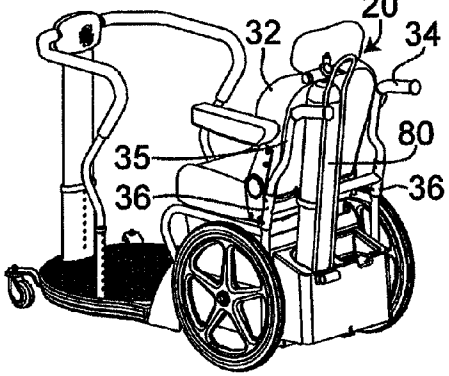
Figure 8C:
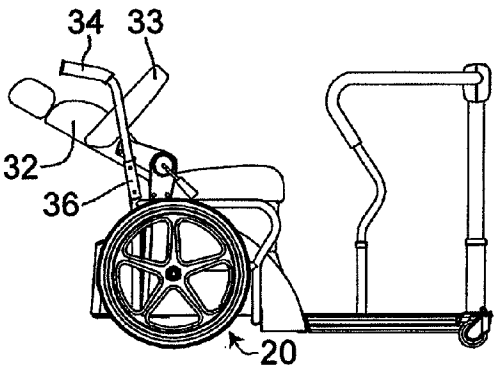
FIGS. 8A, 8B and 8C are views taken at similar angles to those of FIGS. 7A, 7B, and 7C, respectively, showing the seat in a reclined position and the rear handles angled outwardly.
Figure 8B:
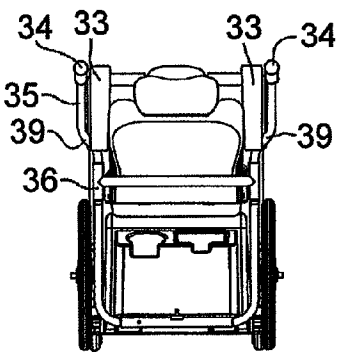
Figure 8A:
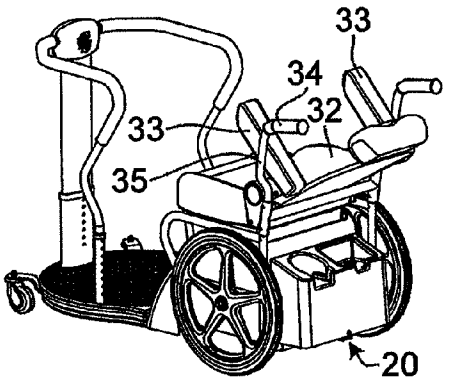
Figure 9:
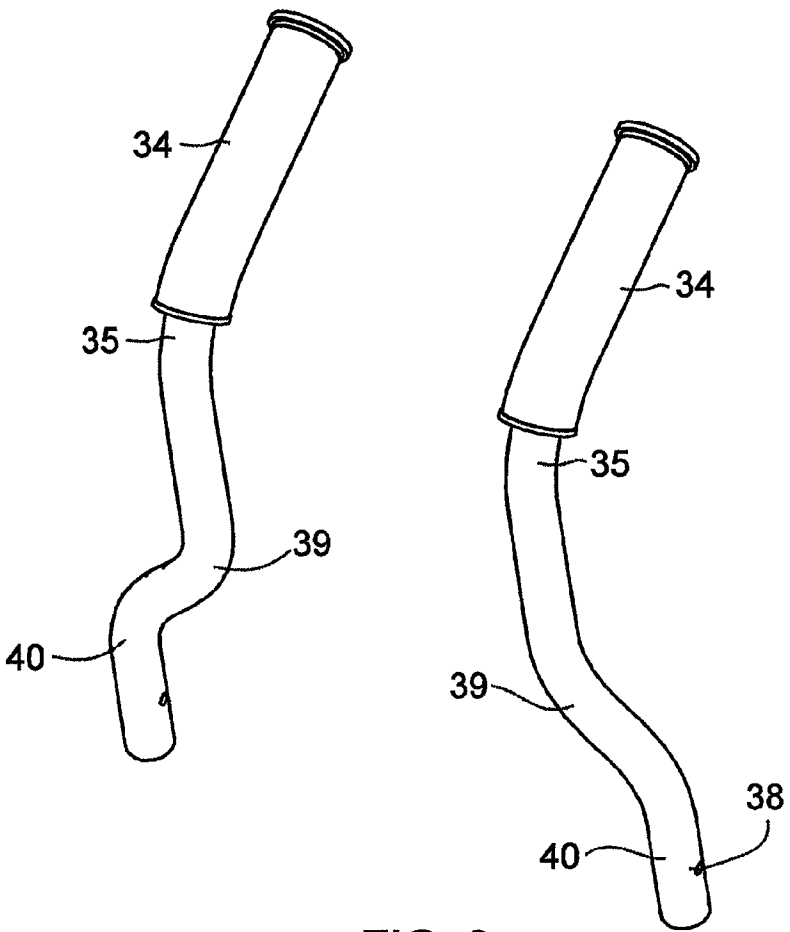
FIG. 9 is a perspective view of the rear handles.

Referring now to FIGS. 6, 7A-C, 8A-C, and 9 there is shown, among other features, details of the attendant gripping handles 34 and related portions at the rear of the medical assist device 20. Referring specifically to FIGS. 6 and 9, the attendant gripping handles 34 have extending therefrom an upper section 35 which follows a straight line path. Downwardly from the upper straight section 35, each gripping handle 34 follows a double curved path forming an S section 39 which is angled inwardly toward a plane P lying on the central axis of the medical assist device 20 when the handles are in the position designated by the numeral (1) in FIG. 6. Extending downwardly from the S section 39 is a lower straight section 40 which is sized to permit it to be received into a housing 36 mounted on a support member 37 supported on the frame 22. The lower straight section 40 has a hole 38 sized to receive a snap button to releasably lock the attendant gripping handle 34 in a fixed position to prevent it from rotating or pulling out. A second hole 38 is on the opposite side of each lower straight section 40. A metal spring steel snap button suitable for this purpose is one manufactured by Valley Tool and Die, North Royalton, Ohio, as it Valco model number A-150.

As can be seen in FIG. 6, the attendant gripping handles 34 are interchangeable such that, if positioned in the housing 36 in the position labeled by the numeral (1), they extend inwardly to a position at which they impede the ability of the seat assembly 26 to recline since the back 32 will hit the inwardly angled gripping handles 34. See also FIGS. 7A, 7B and 7C.

As shown in FIGS. 7A, 7B and 7C, it is frequently desirable or necessary for the patient to have the medical assist device 20 equipped with an oxygen bottle 80. The oxygen bottle is most conveniently supported at the rear of the medical assist device 20 immediately behind the seat back 32. With an oxygen bottle 80 so positioned, it is important that the seat back 32 not be reclined as it would interfere with the oxygen bottle and possibly damage the support mechanism for the oxygen bottle 80. At those times the gripping handles 34 should be positioned so that they angle inwardly as shown in FIG. 7B thereby preventing movement of the seat back to a reclined position.

On the other hand if the patient does not require an oxygen bottle and desires to have the ability to recline the seat back 32 as shown in FIGS. 8A, 8B, and 8C, the respective gripping handles 34 can simply be interchanged so that they are located in the position identified by the numeral (2) in FIG. 6 and in FIG. 8B with their respective S sections 39 angled outwardly. When the gripping handles 34 are positioned with the S sections 39 tapered outwardly to the respective positions identified by the numerals (2) in FIG. 6, the respective upper straight sections 35 are spaced apart a sufficient distance for the seat back 32 to be reclined and fit in between such upper straight sections 35 without interference. As can be clearly seen from FIGS. 8A and 8B, the seat back 32 and its arm rests 33 are positioned between the upper straight sections 35 of the respective side gripping handles 34. The gripping handles 34 can easily be changed from one side to the other by simply pressing the Valco snap button pin to release the lower straight sections of the respective gripping handles 34 and transfer them to the opposing housing 36.

Figure 10:
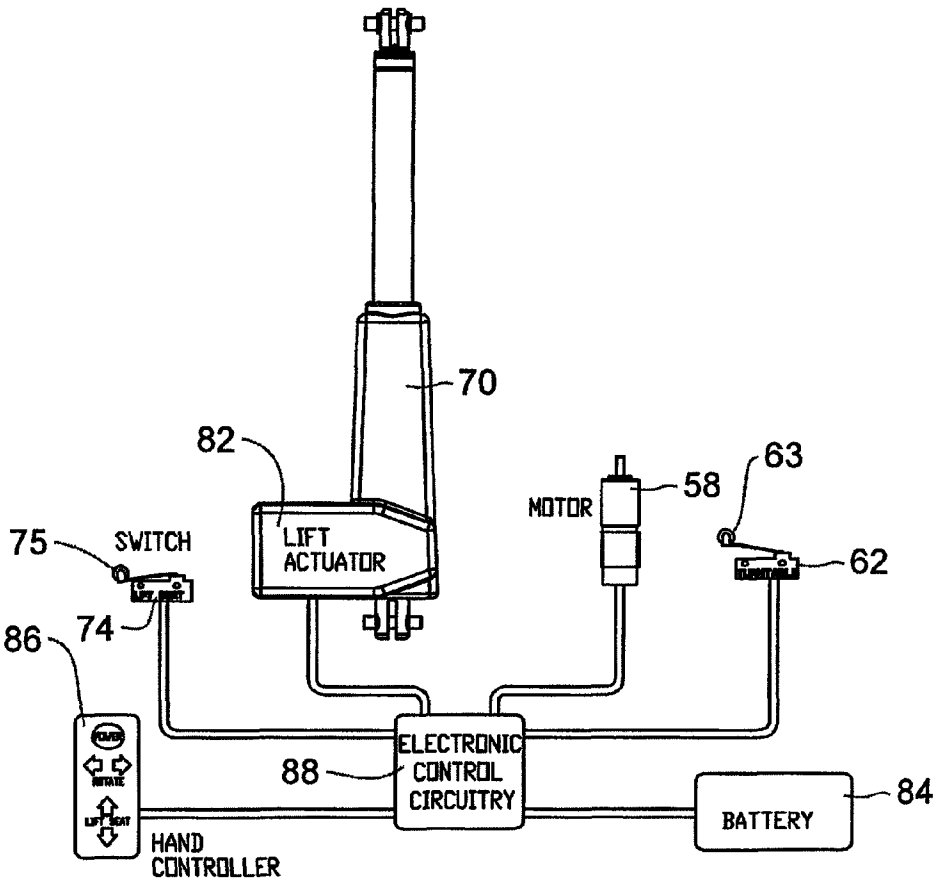
FIG. 10 is a schematic view showing major features of the controls.

Referring to FIG. 10 there is shown schematically a partial layout of the controls for the medical assist device 20 including controlling the motor 58 connected to the worm gear 56 for rotating the rotatable platform 24 and a lift actuator 82 for actuating the electric actuator 70. As previously described, the first contact switch 62 controls actuation of the motor 58 powering rotation of the worm gear 56 for rotation of the rotatable platform 24. The second switch 74 controls actuation of the electric actuator 70 through the lift actuator 82. Power is provided by a battery 84. A hand controller 86 operating through electronic control circuitry 88 is manipulated to actuate the lift actuator 82 and electric actuator 70 when the rotatable platform 24 is positioned so that the seat assembly 30 is positioned centrally aligned with the opening between the gripping handles 34. The electronic control circuitry 88 is manufactured by InSeat Solutions, LLC, Sante Fe, Calif.

It is within the scope of the present invention that other types of switches and actuators could be used to control actuation of the lift actuator mechanism 82 and of the power assembly including magnetic reed switches and/or proximity switches.

The above detailed description of the present invention is given for explanatory purposes. It will be apparent to those skilled in the art that numerous changes and modifications can be made without departing from the scope of the invention.

What is claimed is:

1. A method of transferring a patient, comprising:

rolling a medical assist device to transport a patient sitting on a seat of the medical assist device to a desired location;

raising the seat with an actuator assembly connected to a bottom of the seat to lift the patient onto a rotatable platform of the medical assist device;

rotating the platform until the patient is in a desired rotational position; and allowing the patient to exit the medical assist device at the desired location and the desired rotational position.

2. The method of claim 1, wherein raising the seat to lift the patient comprises lifting the patient from a seated position to a standing position on the rotatable platform.

3. The method of claim 1, further comprising tilting the seat with the actuator assembly to lift the patient onto the rotatable platform.

4. The method of claim 1, wherein raising the seat comprises raising only when gripping bars of the medical assist device are substantially opposite the seat.

5. The method of claim 1, wherein raising the seat comprises raising only when the platform is not rotating.

6. The method of claim 1, further comprising lowering the seat with the actuator assembly to lower the patient to a seated position prior to the rolling step.

7. The method of claim 1, wherein rotating comprises rotating the platform with a motor.

8. The method of claim 1, further comprising lowering the seat and, only after lowering the seat, rotating the platform until the patient is in the desired location.

9. The method of claim 1, wherein allowing the patient to exit comprises assisting the patient off of the medical assist device.

10. The method of claim 9, wherein assisting the patient comprises assisting the patient to a bed, chair, wheelchair, toilet, or bathtub.

11. A method of transferring a patient, comprising:

aligning gripping bars of a medical assist device substantially opposite to a seat of the medical assist device;

locking the gripping bars in place opposite to the seat;

only after locking the gripping bars, raising the seat to lift the patient to a standing position on a rotatable platform of the medical assist device such that the patient can grip the gripping bars;

lowering the seat;

locking the seat in a lowered position;

only after locking the seat, rotating the platform such that the patient is rotated; and allowing the patient to exit the medical assist device.

12. The method of claim 11, wherein aligning the gripping bars comprises rotating the platform until the gripping bars are substantially opposite the seat.

13. The method of claim 11, further comprising tilting the seat to lift the patient to the standing position on the rotatable platform.

14. The method of claim 11, wherein allowing the patient to exit comprises assisting the patient off of the medical assist device.

15. The method of claim 14, wherein assisting the patient comprises assisting the patient from a bed, chair, wheelchair, toilet, or bathtub.

16. The method of claim 11, wherein rotating comprises rotating the platform with a motor.

17. The method of claim 11, further comprising transporting the patient by moving the medical assist device.

* * * * *